US007029248B2

(12) United States Patent
Merz et al.

(10) Patent No.: US 7,029,248 B2
(45) Date of Patent: Apr. 18, 2006

(54) DEVICE FOR VENTING A PUMP UNIT

(75) Inventors: Armin Merz, Weinstatt (DE); Walter Fuchs, Stuttgart (DE); Andreas Dutt, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/493,905

(22) PCT Filed: Feb. 13, 2003

(86) PCT No.: PCT/DE03/00429

§ 371 (c)(1),
(2), (4) Date: Sep. 30, 2004

(87) PCT Pub. No.: WO2004/022967

PCT Pub. Date: Mar. 18, 2004

(65) Prior Publication Data

US 2005/0031472 A1 Feb. 10, 2005

(30) Foreign Application Priority Data

Aug. 29, 2002 (DE) ..... 102 39 777

(51) Int. Cl.
*F04B 39/00* (2006.01)
*F04B 53/06* (2006.01)

(52) U.S. Cl. ..... 417/435; 417/440; 123/516; 137/539

(58) Field of Classification Search ..... 417/307, 417/440, 435; 123/514, 516; 137/539, 580; 285/190

See application file for complete search history.

(56) References Cited

U.S. PATENT DOCUMENTS

| | | | | |
|---|---|---|---|---|
| 4,210,117 | A | 7/1980 | Brinkman | |
| 4,459,964 | A | 7/1984 | Straubel et al. | |
| 5,992,515 | A * | 11/1999 | Spiegel | 165/283 |
| 6,007,109 | A * | 12/1999 | Schoetz | 285/190 |
| 6,564,776 | B1 * | 5/2003 | Haeberer et al. | 123/456 |

FOREIGN PATENT DOCUMENTS

| | | |
|---|---|---|
| DE | 25 22 374 | 12/1976 |
| DE | 27 42 028 | 3/1979 |
| DE | 40 32 377 | 4/1992 |
| EP | 0 323 984 | 7/1989 |
| GB | 1 022 162 | 3/1966 |
| GB | 1 479 618 | 7/1977 |
| GB | 1 535 003 | 12/1978 |

* cited by examiner

*Primary Examiner*—Charles G. Freay
(74) *Attorney, Agent, or Firm*—Kenyon & Kenyon LLP

(57) ABSTRACT

A pump unit for the metered delivery of fuel to internal combustion engines. The pump unit comprises a housing which comprises a longitudinal bore. Located in the longitudinal bore is an overflow valve, via which fuel flows back through a channel into a fuel tank. The passage can be opened or closed by a spring-loaded closing element. Fastened to the valve shaft of the overflow valve is a ring fitting. In the longitudinal bore of the housing there is an additional thread section, via which air flows out through vent gaps into a cavity of the ring fitting.

9 Claims, 1 Drawing Sheet

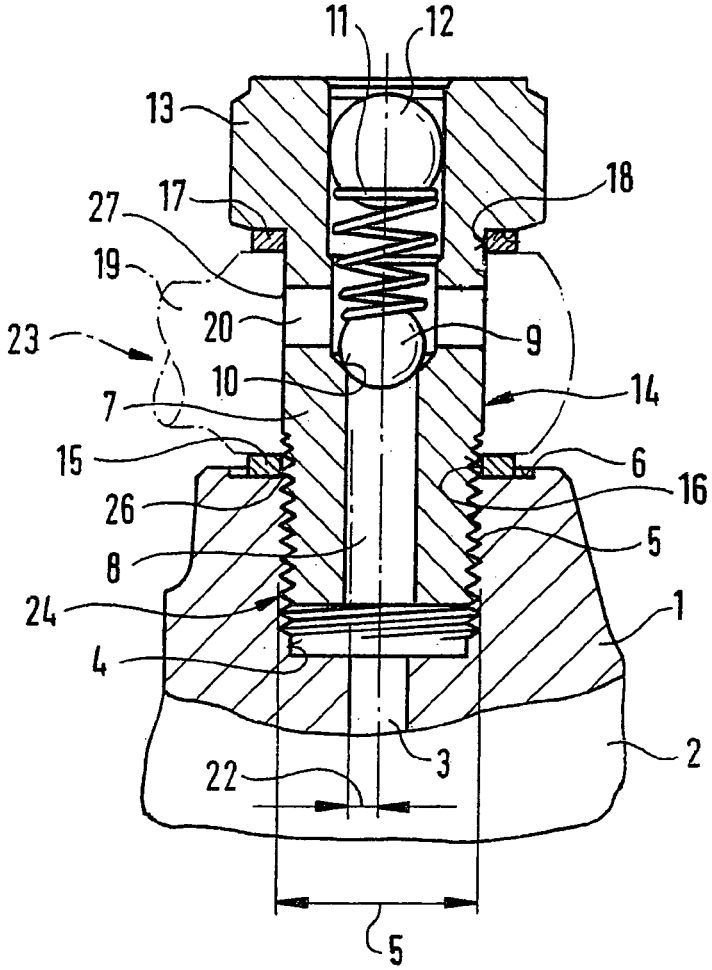
FIG. 1
FIG. 1.1
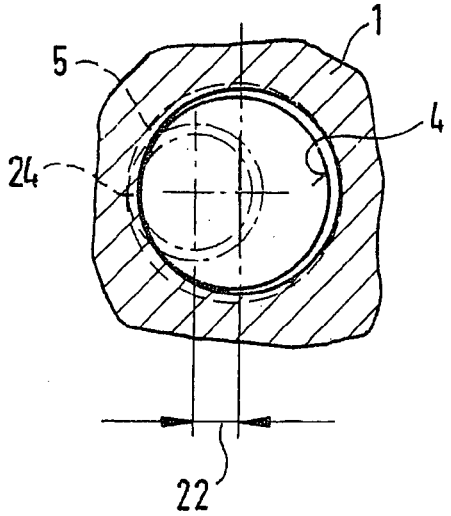
FIG. 2
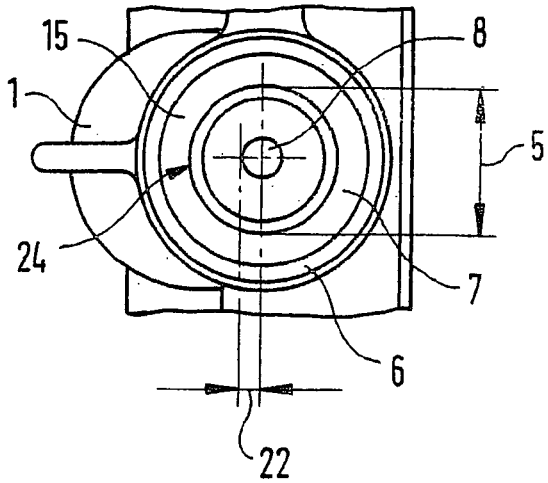

DEVICE FOR VENTING A PUMP UNIT

BACKGROUND INFORMATION

In pump units, such as distributor injection pumps of fuel injection systems in motor vehicles, for example, it is important to ensure a safe venting of the pump unit. For example, a distributor injection pump is vented when the pump is started. Aside from that, when the fuel tank has run empty, air can also be sucked into the distributor injection pump and must then be allowed to escape from the delivery chambers of the distributor injection pump before any fuel can be made to flow.

In a conventional fuel injection pump of this type, described in, for example, German Patent No. DE-OS 25 22 374, recesses in the form of connecting cross sections have been machined into the cylindrical surface of the pump plungers. These recesses extend from the outlet orifices of the discharge channel, starting from the side of the pump working chamber. The recesses can have a rectangular contour, can have different widths in the peripheral direction of the pump plunger and can also differ from one another in their axial dimension, i.e., their length. The purpose of a configuration of this type is to achieve a cross-sectional profile that bends during the opening stroke of the pump plunger. The intent is, after an initially throttled pressure relief, to enlarge the pressure relief cross section via one of the connecting openings by the addition of the second connecting opening. The purpose of these connection cross sections is, in particular, to eliminate the throttling effect that occurs at different rotational speeds of the fuel injection pump. These cutoff bores are provided in particular to adjust the injected fuel quantity as a function of the rotational speed. In this context, one of the connecting cross sections is generally realized in the form of a throttle slot. One of the requirements for self-igniting internal combustion engines, when they are operating in the low-load range, and particularly at idle, is that the fuel must be injected into the combustion chamber in a precisely timed manner, but with an extended injection period. This method prevents "knocking" of the internal combustion engine, which is particularly noticeable when the engine is operating at idle. The purpose of the extended injection period is to ensure that the quantity of fuel injected during the ignition lag does not become too great, and therefore to ensure that too much fuel is not ignited suddenly, which would lead to a sudden increase in pressure which causes knocking.

German Patent No. DE 36 44 150 describes a fuel injection pump for internal combustion engines. This pump has a pump cylinder which is both reciprocating and rotates, and can therefore be used as a distributor of the fuel delivered to a plurality of pump plungers that supply injection points. The pump plunger delimits a pump working chamber in the pump cylinder. The quantity of fuel delivered by the pump plunger is controlled by varying the opening of an outlet orifice on the pump plunger periphery of a discharge channel that is located in the pump plunger and leads from the pump working chamber to a discharge chamber using an annular slide valve that can be moved axially on the pump plunger by an injected-fuel quantity regulator inside the discharge chamber. The annular slide valve has a control edge and at least two connection cross sections of different shapes situated in the connection between the outlet orifice and the connection to the discharge chamber created during the pump plunger delivery stroke by the control edge on the annular slide valve. One of the connection cross sections has a reduced cross section that has a throttling action and is connected first with the discharge chamber during the pump plunger delivery stroke and before another non-throttling connection cross section which has a larger cross section.

European Patent No. EP 0 323 984 describes a fuel injection system for internal combustion engines. This system includes a high-pressure pump that delivers a specific quantity of fuel per pump cycle from a pump working chamber using a first control valve that is located in a first discharge channel, controls a first return quantity, and determines, in particular, the beginning and end of the delivery of the fuel injection. Also provided are a metering port having a constant cross section, and an electrically controlled second control valve which is connected in series thereto and is located in a second discharge channel for a second return quantity. An electronic control unit is used to process the characteristics of the internal combustion engine and of the fuel injection pump into the control variables that regulate the injection. In the second discharge channel, a differential-pressure gauge is provided to measure the quantity and has an element which is flexibly positioned against a restoring force, and is pressurized against the restoring force on the one hand by the pressure on the working-chamber-side of the pump upstream of the metering port, and, on the other hand, by the discharge-side pressure downstream of the metering port. Its excursion is measured by a travel sensor as a characteristic of the differential-pressure gauge. In the electronic control unit, in addition to the characteristics of the differential-pressure gauge and of the second control valve, the quantity of fuel flowing out via the second discharge channel is determined in the form of a control value, and the control time of the first control valve is modified on the basis of this control value.

SUMMARY

In accordance with an example embodiment of the present invention, the need for, for example, an additional bypass bore in the overflow valve on a distributor injection pump is eliminated. In overflow valves, this additional bypass bore represents an additional working step in the large-scale production of the values, which, on the one hand, requires repeated chucking of the workpiece in the processing machine in question and, on the other hand, has a significant influence on the accuracy of the calibration of the overflow valve. The approach proposed by the present invention enables the bypass bore previously realized in the overflow valve to be advantageously integrated into the longitudinal bore of the pump housing quite simply from a manufacturing standpoint, by introducing an additionally deepened thread section during the circular milling of the thread into the housing. This thread section is fabricated in a single work operation process with the female thread in the longitudinal bore, into which the overflow valve is introduced, the tool moving downward along a helical path during the tensioning process.

The thread section may be introduced into the longitudinal bore of the housing in such a way that the longitudinal bore runs at an offset, i.e., eccentrically, with respect to the outer flanks of the overflow valve. As a result of the eccentrically formed thread section, a gap that runs in a cascade form is created between the female and male thread. This gap forms a defined throttling point.

The thread section, which is manufactured in a single working step in the female thread of the longitudinal bore of the pump housing preferably by circular milling, ensures that the air is sucked in from the interior of a pump unit, such as a distributor injection pump. There is negligible escaping of fuel through the gap between the female and male threads, because air has a significantly lower viscosity than fuel and can therefore escape through the gap between the female and male threads more easily than fuel.

A ring fitting, which has a cavity, is assigned to the overflow valve which is inserted exemplarily into the longitudinal bore of the pump housing of a distributor injection pump. The cavity of the ring fitting communicates via a transverse bore in the valve shaft with the longitudinal bore of the overflow valve. The ring fitting may be sealed with respect to the valve shaft of the overflow valve by two sealing washers, one of which is located in the head region of the overflow valve and the other opposite a plane surface of the pump housing. The outside diameter of the valve shaft in the overflow valve and the inside diameter of the two sealing washers are advantageously coordinated so that vent gaps are formed, via which an escape of air from the interior of the pump unit is ensured.

In addition to its use on fuel pump units, for example on distributor injection pumps, the approach of the present invention may also be used in pump units for hydraulic fluid, in power steering systems, for example. The approach of the present invention may also be used in general for low-pressure inlet and outlet lines which are fastened by ring fittings and perform a bypass throttling function.

BRIEF DESCRIPTION OF THE DRAWINGS

An example embodiment of the present invention is explained in greater detail below with reference to the accompanying drawings.

FIG. 1 is a longitudinal section through an overflow valve integrated into the housing of a distributor injection pump.

FIG. 1.1 shows the relative position between female thread of the longitudinal bore and an additional thread section.

FIG. 2 is a plan view of the inner contour of the housing without the overflow valve illustrated in FIG. 1 screwed in.

DETAILED DESCRIPTION OF EXAMPLE EMBODIMENTS

FIG. 1 shows a longitudinal section through an overflow valve that is integrated into the housing of a distributor injection pump.

The housing of a pump such as a distributor injection pump, for example, that delivers a fluid, such as fuel, for example, in direct-injection and air-compression-type internal combustion engines is identified by reference numeral 1 and delimits an interior space 2 of the pump. Interior space 2 of the pump unit is in communication via a first bore 3 with an overflow valve 7 located in a longitudinal bore 4. Overflow valve 7 may be screwed in via a threaded segment 5 designed as a male thread into a corresponding female thread segment in longitudinal bore 4. The threaded connection illustrated in FIG. 1 ensures a connection between overflow valve 7 and housing 1 that is able to withstand even the elevated pressures in a distributor injection pump for internal combustion engines, for example.

In the upper portion of housing 1, a plane surface 6 may be formed, surrounding longitudinal bore 4 in housing 1 in the shape of a ring, into which plane surface a ring 15 made of a soft-metal material which acts as a first sealing washer may be placed. In the example embodiment illustrated in FIG. 1, first sealing washer 15 created in this manner is inserted as a seal between a ring fitting 15 which surrounds valve shaft 14 of overflow valve 7 and plane surface 6 of housing 1 of the pump unit. Opposite first sealing washer 15, which is made of a soft metal material, a second sealing washer 17, which may also be fabricated from a soft metal material, is set in below head region 13 of overflow valve 7, To ensure the required sealed contact and to apply the necessary preloading force, second sealing washer 17 engages on a plane surface 18 on head region 13 of overflow valve 7 and, analogously to first sealing washer 15, which is accommodated on plane surface 6 of housing 1, is connected to an outer surface of ring fitting 19.

By screwing overflow valve 7 into female threaded section 5 of longitudinal bore 4, the preloading force required to create the seal is applied and ring fitting 19 is fastened to the outside of valve shaft 14 of overflow valve 7.

Overflow valve 7 itself includes a passage 8 which is in communication with first bore 3 of housing 1 of the pump unit. Passage 8, as a function of the pressure prevailing in interior space 2 of the housing, may be closed or opened by a closing element 9 that has a spherical shape. For this purpose, pressure is applied to the spherically shaped closing element 9 by a coil spring 11 which in turn is supported on a counter-support 12 in head region 13 of overflow valve 7. In the variant of the approach of the present invention illustrated in FIG. 1, counter-support 12 is designed in the form of a ball that has been shrink-fitted into head region 13 of overflow valve 7. In addition to the shrink-fitting of a spherically shaped counter-support 12, a counter-support of the spring that acts on spherically shaped closing body 9 may also be realized in the form of a counter-support that is bolted into the vicinity of head 13 of overflow valve 7.

Spherical closing element 9 closes a valve seat 10 formed in passage 8 underneath a transverse bore 20 that runs through the wall of valve shaft 14 of overflow valve 7. As a function of the pressure level prevailing in pump interior 2, upon reaching a specific pressure limiting value in passage 8, closing body 9 is lifted by the pressure, counter to the spring action of spring 11, so that fuel is able to flow out of pump interior 2 via transverse bore 20 of overflow valve 7 into a cavity, denoted by reference numeral 23, of ring fitting 19, and, from there, into the fuel tank (not shown) of a motor vehicle.

Displaced by a distance 22, i.e., an eccentricity, from the center line of passage 8, a thread section 24 is formed in female thread segment 5 of longitudinal bore 4 of housing 1. Because additional thread section 24 extends through the threads of the first threaded segment formed in longitudinal bore 4, and, in this way, forms a channel for the passage of air to the outside of valve shaft 14 of overflow valve 7, the center of additional thread section 24 is offset by above mentioned eccentricity 22 with respect to the center line of passage 8 in the interior of valve shaft 14 of overflow valve 7. Thread section 24 is advantageously fabricated in the same working step as the manufacture of female thread segment 5 in longitudinal bore 4 of housing 1 of the pump unit. Circular milling may be considered a preferred fabrication method, so that additional thread section 24 may be fabricated in threads of first threaded segment 5 of longitudinal bore 4 in housing 1 simultaneously with first female thread segment 5 of longitudinal bore 4.

The above mentioned sealing washers 15 and 17 are located on both sides of ring fitting 19 which surrounds the outside periphery of valve shaft 14 of overflow valve 7. Inside diameter 16 of first sealing washer 15 is selected in such a way that air may flow via bore 3, along the channel formed between female thread segment 5 of longitudinal bore 4 and additional thread section 24 on the outside of valve shaft 14 of overflow valve 7 toward the first sealing washer. Between inside diameter 16 of first sealing washer 15 and the outside diameter of valve shaft 14, a first vent gap 26 is formed, via which air is able to escape from pump interior 2. The fuel cannot escape because of the small size of vent gap 26. The escape of fuel is also prevented by closing element 9, which is held in its seat 10 by spring element 11. Air may escape from pump interior 2 of pump unit 1 even at a significantly lower pressure level, compared with the overpressure level at which closing element 9 moves out of its seat 10 on the upper side of passage 8 against the action of spring element 11.

In addition to vent gap 26 which is formed between the periphery of valve shaft 14 of overflow valve 7 and inside diameter 16 of first sealing washer 15, there is an additional vent gap 27 between the inside diameter of ring fitting 19 and the outside diameter of valve shaft 14 of overflow valve 7. Via this air gap, which is sealed externally due to the preloading of first sealing washer 15 and of second sealing washer 17, the air that escapes from interior space 2 of pump unit 1 flows into cavity 23 of ring fitting 19 and, from there, for example, to a tank vent or directly back into the fuel tank of a motor vehicle.

FIG. 1.1 is a schematic illustration of the configuration and of the position of the first threaded segment and of the additional thread section with respect to each other in longitudinal bore 4.

The illustration in FIG. 1.1 shows that a first female thread 5 is cut into longitudinal bore 4 in housing 1 of the pump unit. An additional thread section 24 is machined in its threads, using circular milling in a single working step, and for its part, extends through the threads of first female thread segment 5 inside longitudinal bore 4, so that, viewed along longitudinal bore 4 in the axial direction, a channel is formed, via which any air that is present in interior space 2 of pump unit 1 may escape. Because the diameter of additional thread section 24 is smaller than the diameter of first threaded segment 5 in longitudinal bore 4 of housing 1 of the pump unit, additional thread section 24 is offset by an eccentricity 22 with respect to the center of first threaded segment 5. In terms of the manufacturing requirements, therefore, additional thread section 24 may be fabricated in a single operation simultaneously with the manufacture of first threaded segment 5—which is realized in a larger tip diameter. In the approach of the present invention, the need is eliminated for calibrating bypass openings in an overflow valve 7, of the type that was necessary on conventional overflow valves, because the bypass opening may be integrated directly into longitudinal bore 4 of housing 1 of a pump unit.

FIG. 2 is a plan view of the threaded bore in housing 2.

FIG. 2 shows that overflow valve 7 may be screwed with its first threaded segment 5 into a longitudinal bore 4 of housing 1. Threaded segment 5—which is realized in the form of a male thread in the lower region of valve shaft 14 of overflow valve 7—is engaged with corresponding threaded segment 5 which is realized in the form of a female thread of longitudinal bore 4 in housing 1, additional thread section 24 between the male thread of valve shaft 14 and female thread segment 5 of longitudinal bore 4 creating a channel that permits the escape of air, which channel however is sealed externally by first sealing washer 15 which is placed into plane surface 6 of housing 1. It is thereby possible for the air to flow out of the interior via vent gaps 26 and 27 illustrated in FIG. 1 into interior 23 of ring fitting 19 surrounding valve shaft 14 and, from there, into the vehicle tank or a tank vent.

The eccentricity 22 by which additional thread section 24 is offset with respect to the center of female thread 5 of longitudinal bore 4 is also identified by reference number 22 in FIG. 2. Eccentricity 22 results from the realization of additional thread section 24 in a smaller tip diameter compared with the diameter of female thread 5 in longitudinal bore 4 of housing 1, for example of a distributor injection pump for air-compression-type internal combustion engines. In addition to its use for venting distributor injector pumps, which can be necessary when the tank of a motor vehicle is run completely empty and when distributor injection pump 1 is started, the method proposed by the present invention for venting a pump interior may also be used in hydraulic fluid pumps in motor vehicles, such as in a power steering system, for example. The approach proposed by the present invention for venting the pump interior may also be used in fuel pump units for diesel fuel, as well as for gasoline.

The method proposed by the present invention for venting a pump interior 2 of a pump unit enables the circular milling manufacturing method to be used to machine the vent channel that functions as a bypass into longitudinal bore 4 of housing 1. This eliminates the need for forming an additional bypass bore in overflow valve 7 which is screwed into longitudinal bore 4 on housing 1. As a result, it is possible to reduce the number of rejects during the installation of overflow valves 7 in the pump unit, because the influence of the bypass bore is eliminated and this additional processing step in the manufacture of overflow valves 7 in series production may be eliminated. The bypass bore is advantageously realized in an additional thread section 24 that may be manufactured in a single operation with the machining of female thread segment 5 in a longitudinal bore 4 in housing 1 of the pump unit in question.

What is claimed is:

1. A pump unit for metered delivery of fuel for an internal combustion engine comprising:

a housing which surrounds an interior space and includes a longitudinal bore;

an overflow valve arranged in the longitudinal bore and via which fuel flows back through a passage into a fuel tank, the passage being able to be closed or opened by a spring-loaded closing element; and a ring fitting held on a periphery of the overflow valve, wherein a thread section is formed in the longitudinal bore of the housing, via which air can escape via vent gaps into a cavity of the ring fitting, wherein the thread section is formed in a first female thread segment to receive the overflow valve of the longitudinal bore.

2. The pump unit as recited in claim 1, wherein a center of the thread section is located at an offset from a center of the first female thread segment in the longitudinal bore.

3. The pump unit as recited in claim 1, wherein the thread section in the first female thread segment is one of fabricated by circular milling, or fabricated in an additional operation.

4. The pump unit as recited in claim 1, further comprising:

sealing washers, wherein between a peripheral surface of a valve shaft of the overflow valve and the sealing washers on the valve shaft, the vent gaps are realized, via which air escaping from an interior space of the pump unit flows out into the ring fitting via the thread section of the longitudinal bore.

5. The pump unit as recited in claim 1, wherein the overflow valve has a passage and a transverse bore which is in communication with the cavity of the ring fitting, the passage being closed by the closing element, and being opened as a function of pressure in the interior space of the housing.

6. A pump unit for metered delivery of fuel for an internal combustion engine comprising:

a housing which surrounds an interior space and includes a longitudinal bore;

sealing washers;

an overflow valve arranged in the longitudinal bore and via which fuel flows back through a passage into a fuel tank, the passage being able to be closed or opened by a spring-loaded closing element; and a ring fitting held on a periphery of the overflow valve, wherein a thread section is formed in the longitudinal bore of the housing, via which air can escape via vent gaps into a cavity of the ring fitting, wherein between a peripheral surface of a valve shaft of the overflow valve and the sealing washers on the valve shaft, the vent gaps are realized, via which air escaping from an interior space of the pump unit flows out into the ring fitting via the thread section of the longitudinal bore, and wherein the vent gaps are defined by respective inside diameters of a first one of the sealing washers and a second one of the sealing washers.

7. A pump unit for metered delivery of fuel for an internal combustion engine comprising:

a housing which surrounds an interior space and includes a longitudinal bore;

sealing washers;

an overflow valve arranged in the longitudinal bore and via which fuel flows back through a passage into a fuel tank, the passage being able to be closed or opened by a spring-loaded closing element; and a ring fitting held on a periphery of the overflow valve, wherein a thread section is formed in the longitudinal bore of the housing, via which air can escape via vent gaps into a cavity of the ring fitting, wherein between a peripheral surface of a valve shaft of the overflow valve and the sealing washers on the valve shaft, the vent gaps are realized, via which air escaping from an interior space of the pump unit flows out into the ring fitting via the thread section of the longitudinal bore, and wherein a first one of the sealing washers is placed into a plane surface that is adjacent to the longitudinal bore in the housing.

8. A pump unit for metered delivery of fuel for an internal combustion engine comprising:

a housing which surrounds an interior space and includes a longitudinal bore;

sealing washers;

an overflow valve arranged in the longitudinal bore and via which fuel flows back through a passage into a fuel tank, the passage being able to be closed or opened by a spring-loaded closing element; and a ring fitting held on a periphery of the overflow valve, wherein a thread section is formed in the longitudinal bore of the housing, via which air can escape via vent gaps into a cavity of the ring fitting, wherein between a peripheral surface of a valve shaft of the overflow valve and the sealing washers on the valve shaft, the vent gaps are realized, via which air escaping from an interior space of the pump unit flows out into the ring fitting via the thread section of the longitudinal bore, and wherein a second one of the sealing washers is in contact with a ring-shaped plane surface in a vicinity of a head of the overflow valve.

9. A pump unit for metered delivery of fuel for an internal combustion engine comprising:

a housing which surrounds an interior space and includes a longitudinal bore;

an overflow valve arranged in the longitudinal bore and via which fuel flows back through a passage into a fuel tank, the passage being able to be closed or opened by a spring-loaded closing element;

a ring fitting held on a periphery of the overflow valve; and a spring, a counter-support of the spring configured to press against the closing element, the counter-support being in the form of a sphere that is pressed or shrink-fitted into a head region of the overflow valve, wherein a thread section is formed in the longitudinal bore of the housing, via which air can escape via vent gaps into a cavity of the ring fitting, and wherein the overflow valve has a passage and a transverse bore which is in communication with the cavity of the ring fitting, the passage being closed by the closing element, and being opened as a function of pressure in the interior space of the housing.

* * * * *